US007871504B2

(12) United States Patent
Barker et al.

(10) Patent No.: US 7,871,504 B2
(45) Date of Patent: Jan. 18, 2011

(54) METHOD FOR FORMING AN ELECTROCATALYTIC SURFACE ON AN ELECTRODE AND THE ELECTRODE

(75) Inventors: Michael Harold Barker, Pori (FI); Olli Hyvärinen, Pori (FI); Karri Osara, Noormarkku (FI)

(73) Assignee: Outotec Oyj, Espoo (FI)

( * ) Notice: Subject to any disclaimer, the term of this patent is extended or adjusted under 35 U.S.C. 154(b) by 461 days.

(21) Appl. No.: 12/090,638

(22) PCT Filed: Sep. 26, 2006

(86) PCT No.: PCT/FI2006/000314

§ 371 (c)(1),
(2), (4) Date: Apr. 17, 2008

(87) PCT Pub. No.: WO2007/045716

PCT Pub. Date: Apr. 26, 2007

(65) Prior Publication Data

US 2008/0237036 A1 Oct. 2, 2008

(30) Foreign Application Priority Data

Oct. 21, 2005 (FI) ..... 20051059

(51) Int. Cl.
*C25B 11/04* (2006.01)
*C25B 11/06* (2006.01)
*C25B 11/16* (2006.01)

(52) U.S. Cl. ..... 204/290.01; 204/291; 502/101; 148/516; 148/537; 429/233; 429/245

(58) Field of Classification Search ..... 502/101; 148/516, 537; 204/290.01, 291; 429/233, 429/245

See application file for complete search history.

(56) References Cited

U.S. PATENT DOCUMENTS

| | | | | |
|---|---|---|---|---|
| 4,265,728 | A * | 5/1981 | Suchanski et al. | 204/290.03 |
| 4,392,927 | A | 7/1983 | Fabian et al. | |
| 4,528,084 | A | 7/1985 | Beer et al. | |
| 6,071,570 | A | 6/2000 | Hardee et al. | |
| 2003/0215712 | A1 * | 11/2003 | Feddrix et al. | 429/224 |
| 2005/0233066 | A1 | 10/2005 | Sunagawa et al. | |

FOREIGN PATENT DOCUMENTS

| | | |
|---|---|---|
| GB | 2309230 | 7/1997 |
| WO | 9505498 | 2/1995 |
| WO | 9736023 | 10/1997 |

* cited by examiner

*Primary Examiner*—Bruce F Bell
(74) *Attorney, Agent, or Firm*—Chernoff, Vilhauer, McClung & Stenzel

(57) ABSTRACT

The invention relates to a method of forming an electrocatalytic surface on an electrode in a simple way, in particular on a lead anode used in the electrolytic recovery of metals. The catalytic coating is formed by a spraying method which does not essentially alter the characteristics of the coating powder during spraying. Transition metal oxides are used as the coating material. After the spray coating the electrode is ready for use without further treatment. The invention also relates to an electrode onto which an electrocatalytic surface is formed.

17 Claims, No Drawings

METHOD FOR FORMING AN ELECTROCATALYTIC SURFACE ON AN ELECTRODE AND THE ELECTRODE

This is a national stage application filed under 35 USC 371 based on International Application No. PCT/FI2006/000314 filed Sep. 26, 2006, and claims priority under 35 USC 119 of Finnish Patent Application No. 20051059 filed Oct. 21, 2005.

FIELD OF THE INVENTION

The invention relates to a method of forming an electrocatalytic surface on an electrode in a simple way, in particular on a lead anode used in the electrolytic recovery of metals. The catalytic coating is formed by a spraying method which does not essentially alter the characteristics of the coating powder during spraying. Transition metal oxides are used as the coating material. After spray coating, the electrode is ready for use without further treatment. The invention also relates to an electrode onto which an electrocatalytic surface is formed.

BACKGROUND OF THE INVENTION

The electrolytic recovery of metals, especially metals that are more noble than hydrogen, takes place from an aqueous solution of the metal. The recovery of zinc from an aqueous solution can also be performed electrolytically, although zinc is a less noble metal than hydrogen. It is typical of the method that a pure metal is reduced from the solution onto the cathode and a gas forms on the anode, which depending on the conditions is chlorine, oxygen or carbon dioxide. Insoluble anodes are used as the anode. In this case electrolysis is called electrowinning. The most common metals that are produced by electrowinning from an aqueous solution containing sulphuric acid are copper and zinc. The potential in the copper and zinc electrolysis process is regulated to a range in which oxygen is formed at the anode.

Producing a pure metal in electrolysis is the sum total of many factors, but one important factor is the quality of the anode. The anodes used in copper and zinc electrowinning are usually made of lead or lead alloy, where the alloy contains 0.3-1.0% silver and possibly 0.04-0.07% calcium. When the lead based anode described above is used for example in zinc electrolysis, in which the $H_2SO_4$ concentration is of the order of 150-200 g/l, the lead of the anode starts to dissolve and precipitate on the cathode. The precipitation of lead on the cathode also causes short circuits, which impede electrolysis.

Under electrolysis conditions, a layer of lead oxide is formed naturally on the surface of the lead anode, which partially protects the anode from corrosion. In addition, zinc electrolyte usually contains 3-6 g/1 manganese, which over time precipitates a layer of $MnO_2$ on the anode surface. However, when there is a thick layer of $MnO_2$ on the surface of the anode, the anode starts to behave as if it was an $MnO_2$ electrode. The drawbacks of a naturally forming layer of $MnO_2$ are that a thick layer may cause short circuits and part may fall into the electrolyte, if its adhesiveness is poor in places. A solid $MnO_2$ layer is believed to have its own effect on the corrosion of lead anodes and so the precipitation of manganese ions from the electrolyte solution is considered undesirable. A major disadvantage is also that a thick $MnO_2$ layer requires a high anode potential to form oxygen and this raises the energy costs of the process.

Attempts have been made to prevent anodes from corroding in many ways. One way to solve the problem is to form a catalyst layer on the surface of the anode before submersing the anode in the electrolyte, so that the layer protects the anode from corrosion. However, finding a suitable catalyst causes difficulties, because electrolysis operates at fairly high acid concentrations.

Particularly in chlorine-alkali electrolysis, anodes known as dimensionally stable anodes (DSA), which are described for example in U.S. Pat. Nos. 3,632,498 and 4,140,813, have been used for decades. These have also been proposed for use instead of lead electrodes in the electrolysis of zinc and copper because of their energy-saving characteristics, but traditional anodes made of lead alloy are nevertheless still in use in the majority of the world's copper and zinc electrolysis facilities.

Methods are known in which an electrocatalyst is formed on the surface of DSA electrodes. The electrode material, which is usually titanium, is pretreated by etching or sandblasting and can be given further after-treatment by spraying some kind of valve metal such as titanium or its oxide. The final catalytic coating is formed from a solution or suspension of the catalyst or its precursor, such as a metal salt or organometallic compound. These chemicals are generally decomposed thermally i.e. treated in a furnace at a raised temperature to form the desired, catalytically active surface. The catalyst material is a metal or oxide of the platinum group or alternatively one of the following metals: titanium, tantalum, niobium, aluminium, zirconium, manganese, nickel or an alloy thereof. The catalyst layer can be produced on the surface in different ways, such as painting on or by spraying, but the layer formation requires one or several heat treatments at a temperature between 450-600° C. Often further intermediate layers are formed on the electrode surface before the formation of the final protective layer. These kinds of methods are described in e.g. EP patents 407349 and 576402 and U.S. Pat. No. 6,287,631.

A method is described in U.S. Pat. No. 4,140,813, in which a titanium oxide layer is formed on a sandblasted titanium anode by plasma or flame spraying, where the composition of the layer can be affected by means of the spraying temperature and composition of the gas used. In plasma and flame spraying the coating material melts during spraying. The oxide layer that is formed i.e. the electrically conductive substrate layer is further treated with an electrochemically active substance. As activation substances, platinum metals are employed, preferably ruthenium or iridium, as elements or as compounds and they are brushed on top of the oxide layer.

Coatings have also been developed for the surface of a lead anode to protect it and facilitate the development of oxygen. An anode is described in U.S. Pat. No. 4,425,217, Diamond Shamrock Corp., in which the base of lead or lead compound is provided with catalytic particles of titanium, which contain a very small amount of platinum group metal or an oxide thereof. In the coating fabrication method both the anode and the titanium powder are treated by etching and the powder is heat-treated in order to oxidize the precious metal salts into oxides. The powder is attached to the anode surface by pressing.

EP patent 87186, Eltech Systems Corp., presents a means of providing a catalyst used on the surface of a DSA electrode on the surface of a lead anode, in which the catalyst is formed from a titanium sponge, which is equipped with ruthenium-manganese oxide particles. The making of the catalytic coating mentioned above in the environment of a zinc and copper electrolysis facility seems quite difficult and the coating becomes fairly costly. Attaching the powder to the surface of the anode also occurs by pressing.

PURPOSE OF THE INVENTION

The purpose of the present invention is to form a catalytic surface on an electrode, particularly a lead based anode, used in the electrolytic recovery of metals. The surface formed protects the anode from corroding and as an effect of the surface the overpotential of oxygen required at the anode remains low. Methods described in the prior art for forming a catalytic surface require heat treatment and/or etching and possible intermediate layers, but the method now developed is considerably simpler, because the pre-treatment of the anode is straightforward, after which catalyst powder is sprayed directly onto the anode surface and after this the anode is ready for use without any additional further treatment.

SUMMARY OF THE INVENTION

The invention relates to a method for forming an electrocatalytic surface on an electrode and the electrode formed in this way. According to the method the surface of the electrode is sprayed with at least one of the oxides of the transition metals in powder form as a catalytic coating, after which the electrode is ready for use without any separate heat treatments.

The electrode is preferably a lead anode used in the electrolytic recovery of metals. The spraying of the catalyst occurs preferably with HVOF spraying or extremely profitably with cold spraying, in which case the physical and chemical properties of the catalyst powder essentially remain unchanged during spraying, because the temperature change occurring in spraying is minor.

The catalyst is preferably selected to be a transition metal oxide, typically although not compulsorily the form $MO_2$, $MO_3$, $M_3O_4$ or $M_2O_5$, where M is a transition metal.

The catalyst material is preferably one or more of the group: $MnO_2$, $PtO_2$, $RuO_2$, $IrO_2$, $Co_3O_4$, $NiCO_2O_4$, $CoFe_2O_4$, $PbO_2$, $NiO_2$, $TiO_2$, perovskites, $SnO_2$, $Ta_2O_5$, $WO_3$, and $MoO_3$.

The oxides used as catalyst may be simple oxides or synthesized oxides. In a synthesized oxide at least one other oxide of the same metal is attached to the first metal oxide, or one or more oxides of another metal are attached to the oxide of the first metal.

The invention also relates to an electrode, particularly a lead anode, on the surface of which an electrocatalytic coating is formed by spraying at least one transition metal oxide onto it. The electrode is ready for use after spraying without heat treatment.

The essential features of the invention will be made apparent in the attached claims.

DETAILED DESCRIPTION OF THE INVENTION

The essential characteristics of the catalytic coating formed on the surface of the electrode are that it decreases the oxygen overpotential and protects said electrode from corrosion. The catalyst has to be low in price and the formation of the catalytic layer on the surface of the electrode will also be profitable. In addition the catalyst should adhere well to its base.

In the description of the prior art it was mentioned that for example in zinc electrolysis the electrolyte contains manganese, which over time precipitates as manganese dioxide on the surface of the anode, even though this is undesirable. The purpose of the method according to the invention now developed is to form an electrocatalytic layer on the surface of a pure anode that possesses and increases the desired properties, of which one intention is to decrease the uncontrolled precipitation of manganese dioxide on the anode.

In one embodiment of the invention, manganese dioxide is used as the electrocatalyst. With different manufacturing methods it is possible to obtain manganese dioxides with various electrochemical properties. These include for instance beta-manganese dioxide ($\beta MnO_2$), chemically manufactured manganese dioxide (CMD) and electrochemically manufactured manganese dioxide (EMD). Other manganese dioxides that are available commercially are heat-treated (HTMD) and natural manganese dioxide (NMD), which may also be used.

A catalyst coating can be formed on the surface of the anode, which is an mixture of several manganese dioxides manufactured in different ways. Likewise a coating may also be composed of some of the manganese dioxide powders mentioned above, to which some other transition metal oxides have been combined or the coating material is the oxide of some completely different transition metal or metals than manganese oxides.

It is typical of the method according to the invention that the desired composition and characteristics of the transition metal oxide or combination of several oxides are specified before the powder is sprayed on the surface of the electrode. The spraying of the powder occurs preferably in a way that does not essentially change the properties of the powder during spraying. If desired, the oxidation degree of the powder can also be modified a little during spraying. After spraying the electrode is ready for use without further treatment.

When the catalyst powder is sprayed on top of the substrate material, the powder not only forms a layer on its substrate but the catalyst particles are submerged either totally or partially into the substrate material, thus forming a strong mechanical and/or metallurgical bond. This also achieves a good electrical connection between the catalyst and substrate material.

One suitable spraying method is HVOF spraying. High Velocity Oxy-Fuel spraying is based on the continuous combustion of the combustion gas or fluid and oxygen in the combustion chamber of the spray gun at high pressure and in the high-speed gas flow generated by the spray gun. The coating material is fed in powder form by means of a carrier gas, most commonly axially, into the nozzle of the gun. The powder particles heat up in the nozzle for only a very short time before they attach themselves to the substrate material. It was found in the tests carried out that even after the spraying of several catalyst layers the temperature of the substrate was only around 100° C.

A particularly suitable spraying method is known as the cold spraying method, based on kinetic energy. Since there is no flame in the cold spraying method, the coating and substrate material do not undergo much heating and therefore the structure of the coating remains the same during spraying. Cold spraying is based on the supersonic speed of the carrier gas achieved in a Laval-type nozzle. The forming of a coating is based on the deformation of the material and the cold weldability of the metals. This method is used to attain a dense and adhesive coating, as the kinetic energy of the powder particles is changed into mechanical energy and partially also into heat, as a result of which the particles are immersed into the surface to be coated and form a close-fitting mechanical and/or metallurgical join with the substrate.

Measurements were made after the spraying tests that proved that the structure of the coating attached to the substrate material in coating by both the HVOF and the cold spraying techniques was absolutely the same as before spraying. The preservation of the coating structure during spraying is important because in this way the desired composition of the coating material can be controlled and at the same time the entire coating treatment can be done with one spraying, without intermediate or further treatments. Of course spraying can occur as a single sweep of the spraying gun or in several sweeps and the number of sweeps depends on the desired coating thickness, however the coating is essentially completed in one stage.

Before spraying, the substrate material is cleaned either chemically and/or mechanically so that there are no extraneous foreign organic or inorganic elements on the surface in relation to the operating conditions. During cleaning, the oxide layers on the surface of the substrate that are harmful to the adherence of the coating are also removed. Typical pretreatment is grit blasting with whatever blasting medium is thought appropriate. In some cases simple pressure washing with water is enough.

The coating powder with catalytic properties is chosen to correspond in particle size to normal powder used in thermal and cold spraying, or otherwise so that it suits the desired spraying method. The powder is fed through either a powder feeder or other suitable device into the spraying nozzle or gun. The powder feeder may be an ordinary one or one specially developed for the purpose.

In the spraying, the substrate material is coated with powder having catalytic properties to the desired layer thickness. The layer thickness is controlled by the spraying parameters, e.g. the amount of powder fed into the spray gun, the velocity speed of the spray gun in relation to the piece to be coated, the number of coatings i.e. the number of sweeps or by a combination of these. During coating one must watch that the temperature of the coating does not rise unnecessarily. Preferably coating is performed in an air atmosphere.

The particle size of the catalyst powder to be used in coating is preferably in the range of 5-100 μm and the thickness of the coating layer around 1-5 times the diameter of the coating particle. Especially when the substrate material to be coated is a lead anode, it has been found that the coating layer does not need to cover it completely. The coating fulfils its purpose in that case even though the coating particles in the anode surface are separate patches or particles.

Cold spraying is a particularly beneficial spraying method when you wish to keep the coating material in exactly the composition in which it is fed into the spraying apparatus. In cold spraying there is for instance no oxidation during the actual spraying, unless it is expressly desired.

If however, you wish to modify the oxidation degree of the coating material during spraying, that is also possible when the spraying method and conditions are selected corresponding to need. For example the composition of the combustion gas (propane) used in HVOF spraying or the carrier gas (air, nitrogen, helium) used in cold spraying can be used to affect the characteristics of the coating to be generated.

EXAMPLE

The commercially available manganese dioxides $\beta MnO_2$, CMD and EMD were used in the tests carried out. Each powder was sprayed onto of a lead substrate alloyed with silver, with the dimensions of 150×270×8 mm. Brass hangers were attached to the upper edge of the pieces and the anodes formed in this way were tested together with standard anodes (Pb-0.6% Ag) under typical zinc electrolysis conditions. The current density in the electrolysis was 570 $Am^{-2}$ and the concentrations as follows: $Zn^{2+}$ 55 g/l, $H_2SO_4$ 160 g/l, $Mn^{2+}$ about 5 g/l. Aluminium cathodes were used in the electrolysis.

The anodes were taken from the tank for inspection after 72 hours. The inspection was made both visually and by EDX-SEM measurements. The anodes, which had been sprayed with a manganese dioxide layer, had fairly little attached manganese dioxide deposited from the solution, whereas the uncoated standard electrodes clearly had more. The EMD-coated anode i.e. with electrochemically manufactured manganese dioxide, was completely free of manganese dioxide originating from the solution. On the basis of empirical observations we can conclude that the amount of $MnO_2$ in the whole system formed on the surface of electrocatalytically-coated anodes was about half the amount of $MnO_2$ on the uncoated anodes.

The invention claimed is:

1. An electrocatalytically coated electrode, wherein a coating made up mainly of a manganese oxide has been formed on the surface of a lead based anode used in the electrolytic recovery of metals by cold-spraying, the manganese oxide being at least one of the following: beta-manganese dioxide ($\beta$-$MnO_2$), chemically manufactured manganese dioxide (CMD), electrochemically manufactured manganese dioxide (EMD), heat-treated (HTMD) or natural manganese dioxide (NMD).

2. An electrode according to claim 1, wherein the oxide to be used as a coating is a simple oxide or a synthesized one, where a variant oxide of the same metal is attached to the first metal oxide.

3. An electrode according to claim 1, wherein the oxide to be used as a coating is a synthesized one, where one or several oxides of another transition metal are attached to the first metal oxide.

4. An electrode according to claim 1, wherein the manganese oxide has been combined with a transition metal being in the form of $MO_2$, $MO_3$, $M_3O_4$ or $M_2O_5$, where M is a transition metal.

5. An electrode according to claim 4, wherein the transition metal is at least one of the following: $PtO_2$, $RuO_2$, $IrO_2$, $Co_3O_4$, $NiCo_2O_4$, $CoFe_2O_4$, $NiO_2$, $TiO_2$, perovskites, $Ta_2O_5$, $WO_3$, or $MoO_3$.

6. An electrode according to claim 1, wherein the manganese oxide has been combined with $PbO_2$ or $SnO_2$.

7. An electrode according to claim 1, wherein the thickness of the coating to be formed on the electrode is 1-5 times the diameter of the coating powder particle.

8. A method for forming an electrocatalytic surface on an electrode, wherein a catalyst coating in powder form is cold-sprayed in one step on the surface of a lead based anode used in an electrolytic recovery of metals, the coating comprising mainly of a manganese dioxide, being at least one of the following: beta-manganese dioxide ($\beta$-$MnO_2$) , chemically manufactured manganese dioxide (CMD), electrochemically manufactured manganese dioxide (EMD), heat-treated (HTMD) or natural manganese dioxide (NMD).

9. A method according to claim 8, wherein the physical and chemical properties of the catalyst in powder form remain essentially unchanged during spraying.

10. A method according to claim 8, wherein the oxide to be used as a coating is a simple oxide or a synthesized one, where a variant oxide of the same metal is attached to the first metal oxide.

11. A method according to claim 8, wherein the oxide to be used as a coating is a synthesized one, where one or several oxides of another transition metal are attached to the first metal oxide.

12. A method according to claim 8, wherein the manganese oxide is combined with a transition metal being in the form of $MO_2$, $MO_3$, $M_3O_4$, $M_2O_5$, where M is a transition metal.

13. A method according to claim 12, wherein the transition metal is at least one of the following: $PtO_2$, $RuO_2$, $IrO_2$, $Co_3O_4$, $NiCo_2O_4$, $CoFe_2O_4$, $NiO_2$, $TiO_2$, perovskites, $Ta_2O_5$, $WO_3$, or $MoO_3$.

14. A method according to claim 8, wherein the manganese oxide is combined with $PbO_2$ or $SnO_2$.

15. A method according to claim 8, wherein the particle size of the powder to be used in coating is in the region of 5-100 micrometers.

16. A method according to claim 8, wherein the thickness of the coating to be formed on the electrode is 1-5times the diameter of the coating powder particle.

17. A method according to claim 8, wherein the electrode is cleaned chemically and/or mechanically before the formation of the coating on the electrode.

* * * * *